US009494115B2

(12) United States Patent
Devine et al.

(10) Patent No.: US 9,494,115 B2
(45) Date of Patent: Nov. 15, 2016

(54) PUMP CONTROL APPARATUS AND METHOD

(71) Applicant: Continental Automotive Systems, Inc., Auburn Hills, MI (US)

(72) Inventors: David P. Devine, Bloomfield, MI (US); David Humblot, Auburn Hills, MI (US)

(73) Assignee: Continental Automotive Systems, Inc., Auburn Hills, MI (US)

( * ) Notice: Subject to any disclaimer, the term of this patent is extended or adjusted under 35 U.S.C. 154(b) by 89 days.

(21) Appl. No.: 14/492,206

(22) Filed: Sep. 22, 2014

(65) Prior Publication Data

US 2016/0084209 A1 Mar. 24, 2016

(51) Int. Cl.

| | |
|---|---|
| ***F02M 37/04*** | (2006.01) |
| ***F02M 39/02*** | (2006.01) |
| ***F01L 1/047*** | (2006.01) |
| ***F01L 1/14*** | (2006.01) |
| ***F02M 59/44*** | (2006.01) |
| ***F02M 59/10*** | (2006.01) |
| ***F04B 9/04*** | (2006.01) |
| *F02M 59/36* | (2006.01) |
| *F01L 1/053* | (2006.01) |
| *F02M 57/02* | (2006.01) |

(52) U.S. Cl.

CPC ..... *F02M 39/02* (2013.01); *F01L 1/047* (2013.01); *F01L 1/14* (2013.01); *F02M 59/102* (2013.01); *F02M 59/44* (2013.01); *F04B 9/042* (2013.01); *F01L 1/053* (2013.01); *F02M 57/023* (2013.01); *F02M 59/366* (2013.01)

(58) Field of Classification Search

CPC .. F02M 59/102; F02M 39/02; F02M 57/023; F02M 59/366; F01L 1/053

USPC ..... 123/508

See application file for complete search history.

(56) References Cited

U.S. PATENT DOCUMENTS 5,154,143 A * 10/1992 Stutzenberger ..... F01L 9/025 123/90.12

5,390,642 A * 2/1995 Thoma ..... F01L 1/053 123/508

* cited by examiner

*Primary Examiner* — Lindsay Low
*Assistant Examiner* — Charles Brauch

(57) ABSTRACT

A pumping system includes s pump, a mechanical coupling device, and a cam shaft. The pump is effective to transfer fuel into an engine. The mechanical coupling device is coupled to the pump. The cam shaft couples to the mechanical coupling device. The cam shaft has an axis extending there through and rotates about the axis. The rotating of the cam shaft is effective to engage the mechanical coupling device and transfer a mechanical force created by the rotating to the mechanical coupling device. The mechanical coupling device is engaged to allow the mechanical force to be transferred to the fuel pump and activate the fuel pump when fuel is to be moved by the pump. The mechanical coupling device is disengaged to disallow the mechanical force from being transferred to the fuel pump and prevent the operation of the fuel pump.

6 Claims, 4 Drawing Sheets

PUMP CONTROL APPARATUS AND METHOD

TECHNICAL FIELD

This application relates to pumps and, more specifically, the control of pumps in various applications.

BACKGROUND OF THE INVENTION

Pumps are used in various applications. In vehicles, fuel pumps are used to move fuel from the vehicle tank (or other storage areas) to the engine (or other destinations) where the fuel is ignited to operate the engine (or otherwise used). In one particular application that is realized in vehicles, high pressure pumps are used in vehicles to move fuel into the fuel injection system of the engine.

For multi-level or multi-fuel system engines, current high pressure fuel pumps that are utilized and these pumps operate continuously. That is, the pumps are operated regardless of whether there is fuel flowing through the pump or no fuel is flowing through the pump. Unfortunately, when the pump is operated without fuel flow, there is wearing of the moving components of the pump and exposure to high temperature that can lead to pump failure. In other words, the pump continues to operate during engine operation, even though the pump is not being used to provide a pressure into the fuel injection system.

Some current approaches place some fluid in the pump to provide lubrication for the pump components. However, these approaches waste valuable energy and are otherwise complicated, inefficient, and/or costly to accomplish.

Consequently, current approaches either have not addressed these problems or have their own limitations. As a result, some user dissatisfaction has resulted from current approaches.

BRIEF DESCRIPTION OF THE DRAWINGS

For a more complete understanding of the disclosure, reference should be made to the following detailed description and accompanying drawings wherein.

Figure 1:
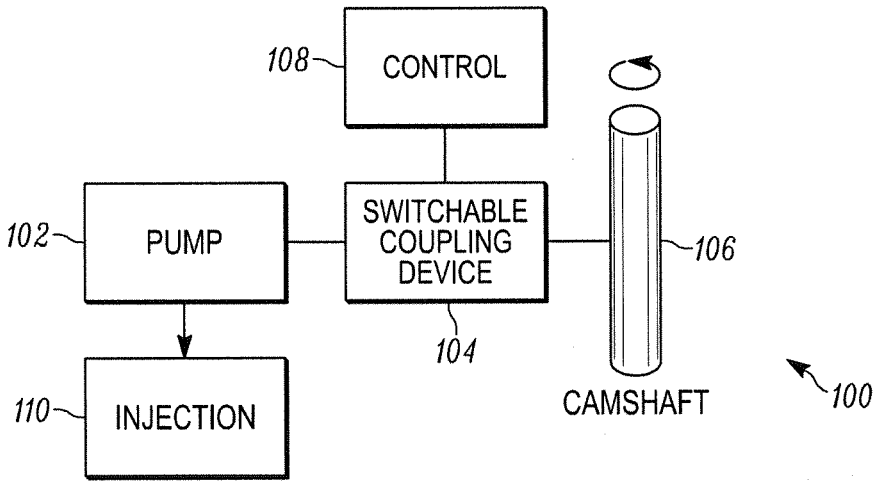
FIG. 1 comprises a block diagram of a system for the control of a fuel pump according to various embodiments of the present invention.

Skilled artisans will appreciate that elements in the figures are illustrated for simplicity and clarity. It will further be appreciated that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

A switchable mechanical coupling device (e.g., a tappet) is used to mechanically halt or stop the movement of the pump to prevent increased wear and failure of the pump. The present approaches remove the parasitic loss of the friction in the pump when it is cycling but is not active, providing additional fuel consumption benefits.

In many of these embodiments, the pump is driven by a camshaft through a switchable mechanical coupling device such as a switchable tappet element or a switching roller tappet. In some example and when a tappet is used, the tappet can be mechanically engaged or disengaged through the use of oil pressure that is controlled by an on/off solenoid (that itself is controlled by a controller). When the tappet is engaged the pump is driven by the rotating cam shaft and this occurs during normal operation (i.e., when it is desired to inject fuel into the engine).

When the tappet is disengaged, the pump is not driven but is in a mechanically idle state (i.e., its moving parts do not move). When the pump is not driven, there is no harmful friction created in the pump since the pump and its internal components are not moving. This allows the pump to operate in alternative fuel systems such as compressed natural gas (CNG), port injected gasoline, and liquefied petroleum gas (LPG) while the injection system is completely deactivated. This has the additional benefit of allowing the same pump to be utilized with multiple and different applications and systems since a specific pump with a low-pressure gasoline circulation is not required.

In many of these embodiments, a pumping system or apparatus includes a pump, a mechanical coupling device, and a cam shaft. The pump is effective to transfer fuel into an engine. The mechanical coupling device is coupled to the pump. The cam shaft couples to the mechanical coupling device. The cam shaft has an axis extending there through and rotates about the axis. The rotating of the cam shaft is effective to engage the mechanical coupling device and transfer a mechanical force created by the rotating to the mechanical coupling device. The mechanical coupling device is engaged to allow the mechanical force to be transferred to the fuel pump and activate the fuel pump when fuel is to be moved by the pump. The mechanical coupling device is disengaged to disallow the mechanical force from being transferred to the fuel pump and prevent the operation of the fuel pump.

In some aspects, the mechanical coupling device comprises a tappet. In some examples, the tappet includes a spring that couples to the fuel pump. In other examples, the tappet comprises a rotating wheel that selectively couples to the cam shaft.

In yet other examples, the tappet comprises a cavity, and the cavity is selectively filled with oil. The disposition of the oil in the cavity is effective to provide a mechanical connection between the spring and the rotating wheel and allow the transfer of the mechanical force through the tappet to the fuel pump.

In other examples, the cam shaft includes a protrusion that engages the rotating wheel. In other aspects, the system further comprises a controller, and the controller engages a solenoid to allow the selective inflow of the oil into the tappet.

Referring now to FIG. 1, one example of a pump control system 100 is described. The system 100 includes a pump 102, a switchable coupling device 104, a cam shaft 106, and a control module 108.

The pump 102 is, in one aspect, a high pressure fuel pump. In this example, the pump 102 moves or causes to move fuel from a tank (or other storage device) to a fuel injection apparatus 110 of an engine. The pump 102 may have a moving piston that creates a pressure to move the fuel from a fuel tank into the fuel injection apparatus. It will be appreciated that although the examples described herein relate to pumps moving fuel for use by engines, that these approaches are not limited to these applications but can be used in other applications as well.

The switchable coupling device 104 is coupled to the pump 102, the control module 108, and the cam shaft 106. The cam shaft 108 rotates and this mechanical force is transferred to the switchable coupling device 104. The cam shaft 108 is a typical cam shaft that is utilized by vehicles.

The switchable coupling device 104 is any device that couples or decouples force transfers between the cam shaft 106 and the pump 102. In one example, the switchable coupling device 104 is a tappet. Other examples are possible. Examples of tappets used as switchable coupling devices are described elsewhere herein. By "tappet" and as used herein it is meant an apparatus, portion, device, projection, or element that imparts a linear motion to some other component within a mechanism.

Figure 2:
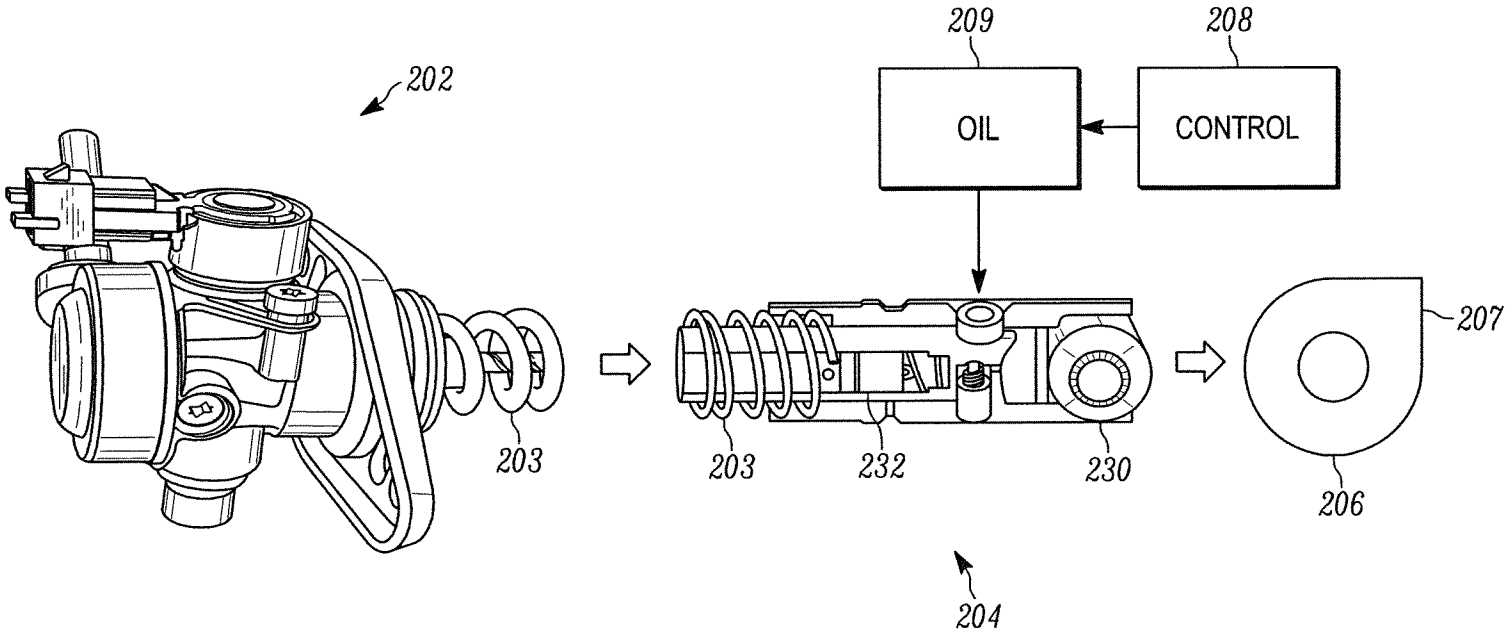
FIG. 2 comprises a block diagram of a system for the control of a fuel pump according to various embodiments of the present invention.

The control module 108 controls the actuation of the switchable coupling device 104. When fuel is needed by the injection apparatus 110, then the control module actuates the switchable coupling device 104 to allow the transfer of mechanical forces from the cam shaft 106 and the pump 102. When the injection system 110 no longer needs fuel, the control module 108 disengages the switchable coupling device 104 to prevent mechanical forces from being transferred from the cam shaft 106 and the pump 102. Consequently and when the pump is not driven, there is no harmful friction created in the pump since the pump and its internal components are not moving Referring now to FIG. 2, one example of a control system for a pump is described. The system includes a pump 202, a switchable coupling device 204 (in this case a tappet), a cam shaft 206 (with a protrusion 207), and a control module 208.

The pump 202 is in one aspect a high pressure fuel pump. In this example, the pump 202 moves fuel from a tank to a fuel injection apparatus of an engine. The pump 202 may have a moving piston that creates a pressure to move the fuel from a fuel tank into the fuel injection apparatus.

The switchable coupling device 204 is coupled to the pump 202 via springs 203. The control module 208 controls the flow of oil 209 into the switchable coupling device 204. The switchable coupling device 204 also couples to a cam shaft 206. The cam shaft 206 rotates and causes a wheel 230 in the switchable coupling device 204 to rotate. This occurs as the protrusion 207 rotates about the axis of the rotational axis of the cam shaft 206, the protrusion impacts the wheel 230.

With oil in the switchable coupling device 204 a cylinder 232 moves, moving the spring 203, which moves the pump 202. In this way, mechanical forces are transferred from the cam shaft 206 to the pump 202 via the switchable coupling device 204.

The control module 208 controls the actuation of the switchable coupling device 204. When fuel is needed by the injection apparatus, then the control module 208 actuates the switchable coupling device 204 by pumping oil into the switchable coupling device 204 to allow the transfer of mechanical forces from the cam shaft 206 and the pump 202. When the injection system no longer needs fuel, the control module 208 disengages the switchable coupling device 204 (e.g., by draining the oil) to prevent mechanical forces from being transferred from the cam shaft 206 and the pump 202. Consequently and when the pump 202 is not driven, there is no harmful friction created in the pump since the pump and its internal components are not moving.

Figure 3A:
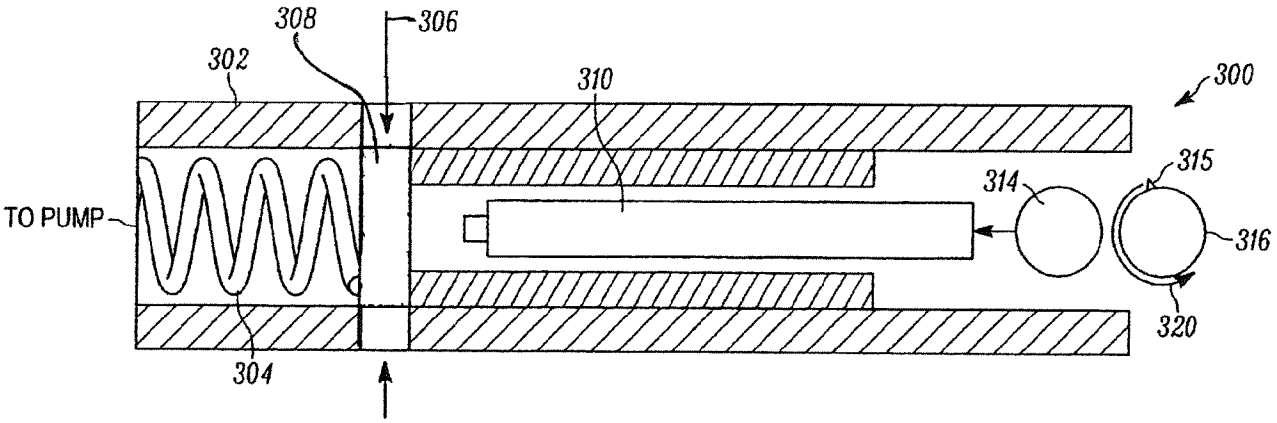
FIG. 3A comprises a diagram of a control system for the control system of a fuel pump with a tappet disengaged according to various embodiments of the present invention.
Figure 3B:
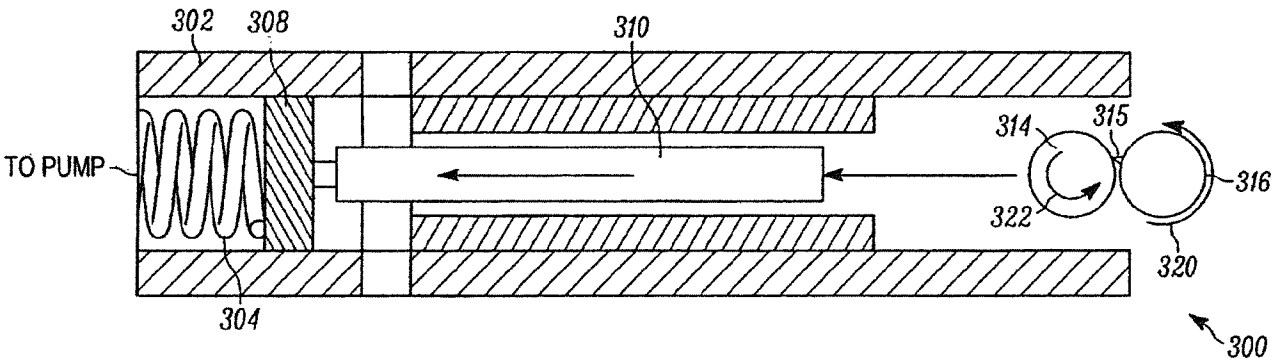
FIG. 3B comprises a diagram of a control system for the control system of a fuel pump with a tappet engaged according to various embodiments of the present invention.

Referring now to FIG. 3A and FIG. 3B, one example of a tappet 300 is described. A tappet includes an outer housing 302, a spring 304, an opening or cavity 308 in which oil pressure 306 is applied by a control module. The tappet 300 includes a cylinder 310 that couples to a wheel 314. The wheel couples to a cam shaft 316 that has a protrusion 315.

When fuel is needed by the injection apparatus, then the control module actuates the tappet by pumping oil 306 into the tappet to allow the transfer of mechanical forces from the cam shaft 316 and the pump. When the injection system no longer needs fuel (or the pump no longer needs to operate), the control module disengages the tappet to prevent mechanical forces from being transferred from the cam shaft 316 and the pump. Consequently the pump is not driven when fuel is not being transferred, and there is no harmful friction created in the pump since the pump and its internal components are not moving during these modes of operation.

With oil 306 in the tappet, the cam shaft rotates in the direction indicated by the arrow labeled 320. This causes the wheel 314 to rotate in the direction indicated by the arrow labeled 322. This moves the cylinder 310, moving the spring 304, which moves a piston in the pump. In this way, mechanical forces are transferred from the cam shaft 316 to the pump. The oil 306 allows the coupling of the mechanical forces. When the oil 306 is removed (e.g., by draining), the mechanical coupling between the cam shaft 306 and the pump is no longer possible.

Figure 4:
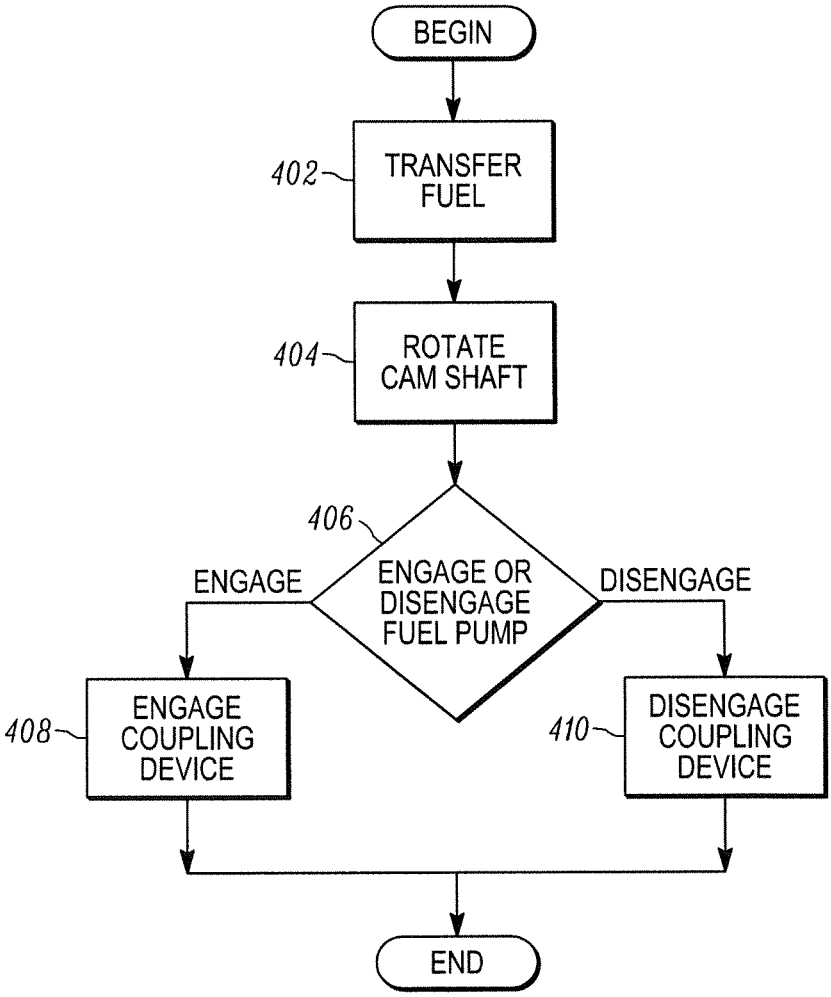
FIG. 4 comprises a flow chart showing one example of an approach for controlling a pump according to various aspects of the present invention.

Referring now to FIG. 4, one example of the operation of the coupling and decoupling system is described. At step 402, it is determined to selectively transfer fuel from a fuel tank into the fuel injection apparatus of an engine. At step 404, the cam, shaft is rotated. At step 406, it is determined whether the fuel pump is to be engaged or disengaged.

If the fuel pump is to be engaged (e.g., fuel is needed in the injection system), at step 408 the mechanical coupling device is engaged to allow the transfer of force between the cam shaft and the pump. This allows fuel to be pumped into the fuel injection apparatus by the pump.

If the fuel pump is not to be engaged (e.g., no fuel is needed in the injection system), at step 410 the mechanical coupling device is disengaged to disallow the transfer of force between the cam shaft and the pump. This prevents fuel to be pumped into the fuel injection apparatus by the pump.

It should be understood that any of the controllers described herein may use a computing device to implement various functionality and operation of these devices. In terms of hardware architecture, such a computing device can include but is not limited to a processor, a memory, and one or more input and/or output (I/O) device interface(s) that are communicatively coupled via a local interface. The local interface can include, for example but not limited to, one or more buses and/or other wired or wireless connections. The processor may be a hardware device for executing software, particularly software stored in memory. The processor can be a custom made or commercially available processor, a central processing unit (CPU), an auxiliary processor among several processors associated with the computing device, a semiconductor based microprocessor (in the form of a microchip or chip set) or generally any device for executing software instructions.

The memory devices described herein can include any one or combination of volatile memory elements (e.g., random access memory (RAM), such as dynamic RAM (DRAM), static RAM (SRAM), synchronous dynamic RAM (SDRAM), video RAM (VRAM), and so forth)) and/or nonvolatile memory elements (e.g., read only memory (ROM), hard drive, tape, CD-ROM, and so forth). Moreover, the memory may incorporate electronic, magnetic, optical, and/or other types of storage media. The memory can also have a distributed architecture, where various components are situated remotely from one another, but can be accessed by the processor.

The software in any of the memory devices described herein may include one or more separate programs, each of which includes an ordered listing of executable instructions for implementing the functions described herein. When constructed as a source program, the program is translated via a compiler, assembler, interpreter, or the like, which may or may not be included within the memory.

It will be appreciated that any of the approaches implemented by controllers can utilize computer instructions stored on a computer media (e.g., a computer memory as described above) and these instructions can be executed on a processing device such as a microprocessor. However, these approaches can be implemented as any combination of electronic hardware and/or software.

Preferred embodiments of this invention are described herein, including the best mode known to the inventors for carrying out the invention. It should be understood that the illustrated embodiments are exemplary only, and should not be taken as limiting the scope of the invention.

What is claimed is:

1. A pumping system for use in a vehicle, the system comprising:

a pump, the pump being effective to transfer fuel into a fuel injection system of an engine;

a mechanical coupling device coupled to the pump;

a controller;

a cam shaft that couples to the mechanical coupling device, the cam shaft having an axis extending there through, the cam shaft rotating about the axis, the rotating of the cam shaft being effective to engage the mechanical coupling device and transfer a mechanical force created by the rotating to the mechanical coupling device;

such that the mechanical coupling device is engaged to allow the mechanical force to be transferred to the fuel pump and activate the fuel pump when fuel is to be moved by the pump and such that the mechanical coupling device is disengaged to disallow the mechanical force from being transferred to the fuel pump and prevent the operation of the fuel pump;

wherein the mechanical coupling device comprises a tappet, and the tappet includes a spring that couples to the fuel pump and a rotating wheel that selectively couples to the cam shaft;

wherein the tappet further comprises a cavity that is separate from the fuel pump and the fuel injection system, the controller being programmed to selectively filling the cavity with oil, the disposition of the oil in the cavity being effective to provide a mechanical connection between the spring and the rotating wheel and allow the transfer of the mechanical force through the tappet to the fuel pump and to move a piston in the fuel pump.

2. The system of claim 1 wherein the cam shaft includes a protrusion that engages the rotating wheel.

3. The system of claim 1 further comprising a solenoid and wherein the controller selectively engages the solenoid to allow the selective inflow of the oil into the tappet.

4. A method of controlling a fuel pump in a vehicle, the method comprising:

transferring fuel into a fuel injection system of an engine using a fuel pump;

providing a mechanical coupling device that is coupled to the pump;

rotating a cam shaft that couples to the mechanical coupling device, the cam shaft having an axis extending there through, the cam shaft rotating about the axis, the rotating of the cam shaft being effective to engage the mechanical coupling device and transfer a mechanical force created by the rotating to the mechanical coupling device;

engaging the mechanical coupling device to allow the mechanical force to be transferred to the fuel pump and activate the fuel pump when fuel is to be moved by the pump and such that the mechanical coupling device is disengaged to disallow the mechanical force from being transferred to the fuel pump and prevent the operation of the fuel pump;

wherein the mechanical coupling device comprises a tappet, and the tappet includes a spring that couples to the fuel pump and a rotating wheel that selectively couples to the cam shaft, and wherein the tappet further comprises a cavity that is separate from the fuel pump and the fuel injection system;

programming the controller to selectively fill the cavity with oil, the disposition of the oil in the cavity being effective to provide a mechanical connection between the spring and the rotating wheel and allow the transfer of the mechanical force through the tappet to the fuel pump and move a piston in the fuel pump.

5. The method of claim 4 wherein the cam shaft includes a protrusion and the method further comprises engaging the protrusion with the rotating wheel.

6. The method of claim 4, further comprising engaging a solenoid to allow the selective inflow of the oil into the tappet.

* * * * *